US012345124B1

(12) United States Patent
Rogers et al.

(10) Patent No.: US 12,345,124 B1
(45) Date of Patent: Jul. 1, 2025

(54) MULTIPLE STAGE CEMENTING TOOL AND METHOD OF USE

(71) Applicant: Citadel Casing Solutions, LLC, Houston, TX (US)

(72) Inventors: Henry E. Rogers, Owasso, OK (US); Julio Alberto Cornejo, Sugar Land, TX (US)

( * ) Notice: Subject to any disclaimer, the term of this patent is extended or adjusted under 35 U.S.C. 154(b) by 0 days.

(21) Appl. No.: 18/651,882

(22) Filed: May 1, 2024

(51) Int. Cl.
*E21B 33/14* (2006.01)
*E21B 34/14* (2006.01)

(52) U.S. Cl.
CPC ..... *E21B 33/146* (2013.01); *E21B 34/14* (2013.01); *E21B 2200/06* (2020.05)

(58) Field of Classification Search
CPC ..... E21B 2200/06; E21B 33/146
See application file for complete search history.

(56) References Cited

U.S. PATENT DOCUMENTS 5,038,862 A 8/1991 Giroux et al.
5,277,253 A 1/1994 Giroux et al.
5,279,370 A 1/1994 Brandell et al.
5,314,015 A 5/1994 Streich et al.
5,348,089 A 9/1994 Brandell et al.
10,655,428 B2 * 5/2020 Giroux ..... E21B 33/146
10,890,047 B2 * 1/2021 Themig ..... E21B 33/16
11,306,562 B1 * 4/2022 Giroux ..... E21B 34/142
12,123,280 B2 * 10/2024 Webber ..... E21B 23/0413

* cited by examiner

*Primary Examiner* — Theodore N Yao
(74) *Attorney, Agent, or Firm* — Avek IP, LLC

(57) ABSTRACT

A cementing tool for use in well drilling operations includes a body forming an inner bore, the body having circulation ports allowing flow from the inner bore to an exterior of the body; an opening sleeve mounted within the body to release from a first opening sleeve position to open the circulation ports when in a second position; an opening seat attached to the opening sleeve; an opening seat collet retainer engaged with the opening seat; a closing sleeve mounted within the body above the opening sleeve and to release from a first closing sleeve position to close the circulation ports; a closing seat attached to the closing sleeve; the closing seat is to apply pressure to the opening seat collet retainer; and the opening seat collet retainer is to release from the opening seat once a predetermined amount of pressure is applied from the closing seat.

10 Claims, 7 Drawing Sheets

MULTIPLE STAGE CEMENTING TOOL AND METHOD OF USE

FIELD OF THE DISCLOSURE

The disclosure relates generally to cementing tools for use in wellbore operations. More specifically, the disclosure relates to a multiple stage cementing tool and method of use that provides for improved cement slurry placement due to a high-pressure rated opening seat that allows for greater annular sections of the wellbore to be cemented in a single stage.

BRIEF SUMMARY OF INVENTION

The following presents a simplified summary of the invention in order to provide a basic understanding of some aspects of the invention. This summary is not an extensive overview of the invention. It is not intended to identify critical elements of the invention or to delineate the scope of the invention. Its sole purpose is to present some concepts of the invention in a simplified form as a prelude to the more detailed description that is presented elsewhere.

In some aspects, the present invention relates to a cementing tool for use in well drilling operations. The cementing tool comprises a body to engage with a casing string and forming an inner bore, the body having one or more circulation ports allowing flow from the inner bore to an exterior of the body. An opening sleeve is mounted within the body and is configured to release from a first opening sleeve position to open the one or more circulation ports when in a second opening sleeve position. An opening seat is attached to the opening sleeve and an opening seat collet retainer is engaged with the opening seat. A closing sleeve is mounted within the body above the opening sleeve, the closing sleeve is configured to release from a first closing sleeve position to close the one or more circulation ports. A closing seat is attached to the closing sleeve and the closing seat is configured to apply pressure to the opening seat collet retainer such that the opening seat collet retainer releases from the opening seat once a predetermined amount of pressure is applied from the closing seat.

In other aspects, the present invention relates to a method of using a cementing tool within a wellbore. The method includes providing the cementing tool having a body forming an inner bore and having circulation ports, an opening sleeve mounted within the body, an opening seat attached to the opening sleeve, an opening seat collet retainer engaged with the opening seat, a closing sleeve mounted within the body, and a closing seat attached within the closing sleeve. Then, running the cementing tool downhole with the opening sleeve in a first opening sleeve position and the closing sleeve in a first closing sleeve position such that the one or more circulation ports are closed via the opening sleeve. Next, applying a first pressure to the opening sleeve such that the opening sleeve disengages from the body and moves to a second opening sleeve position, thereby opening the one or more circulation ports. Then, performing one or more well operations. Next, applying a second pressure to the closing sleeve such that the closing sleeve travels downhole and moves into a closing position, thereby closing the one or more circulation ports. Finally, applying a third pressure to the closing seat such that the closing seat disengages from the closing sleeve such that the closing seat, opening seat, and opening seat collet retainer all travel out of the tool to open the tool to fluid flow.

In yet other aspects, the present invention relates to a combination of an opening sleeve and an opening seat as part of a stage cementing tool. The combination comprises the opening sleeve to be mounted within the stage cementing tool via one or more connectors. The opening seat is coupled to the opening sleeve and an opening seat collet retainer is positioned within the opening seat and attached to the opening seat. The opening seat collet retainer couples the opening seat to the opening sleeve such that the opening seat collet retainer is configured to disengage from the opening seat via application of a predetermined pressure; wherein a release of the opening seat collet retainer from the opening seat allows for the opening seat to disengage from the opening sleeve. Disengagement of the opening seat from the opening sleeve allows for the opening seat and opening seat collet retainer to travel downhole.

BRIEF DESCRIPTION OF THE SEVERAL VIEWS OF THE DRAWINGS

Illustrative embodiments of the present disclosure are described in detail below with reference to the attached drawing figures.

LIST OF REFERENCE NUMBERS

Figure 1:
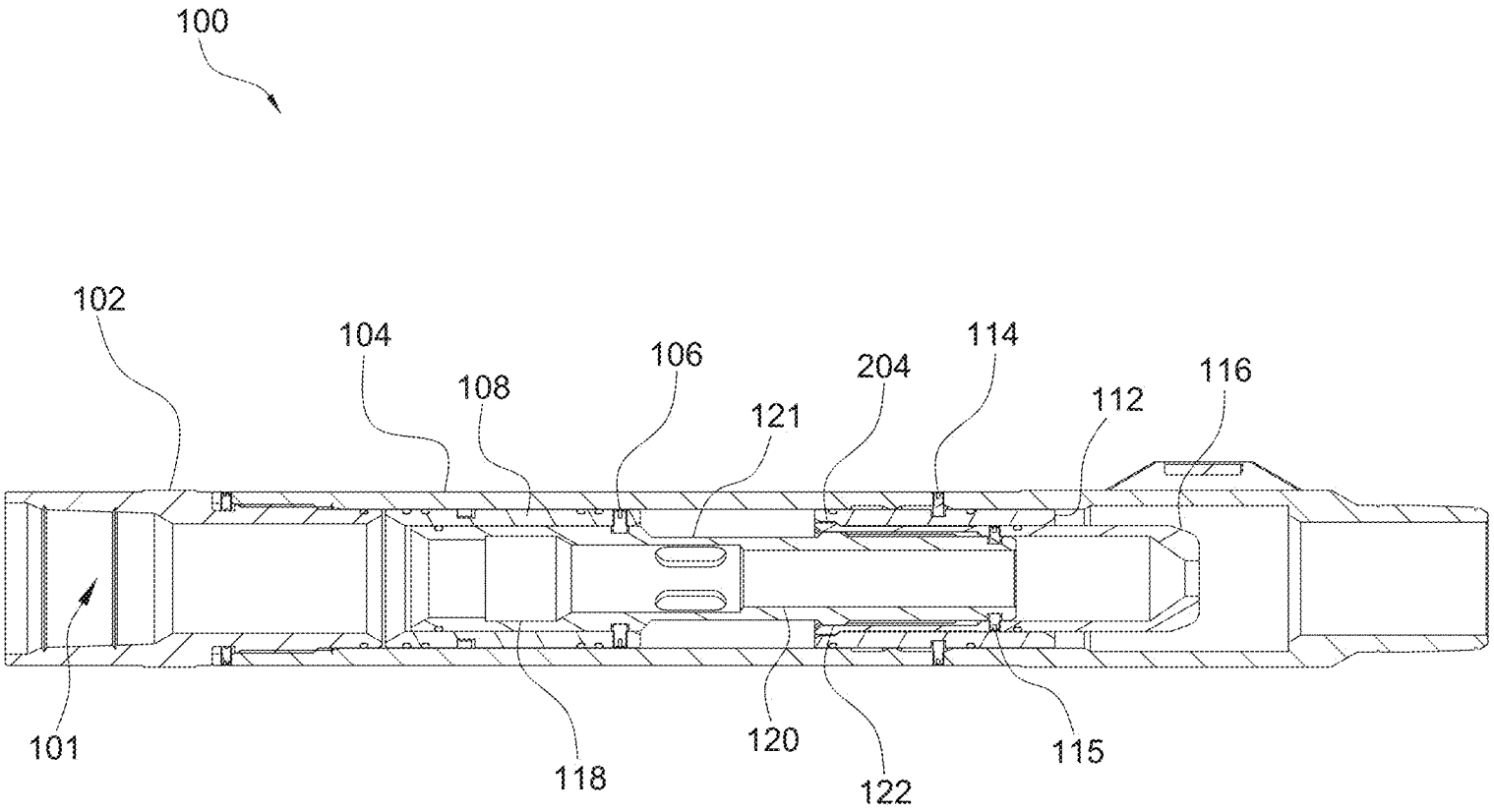
FIG. 1 is a side, cross-sectional view of a multiple stage cementing tool with an opening sleeve in a first position and a closing sleeve in a first position in accordance with the present invention.
Figure 2:
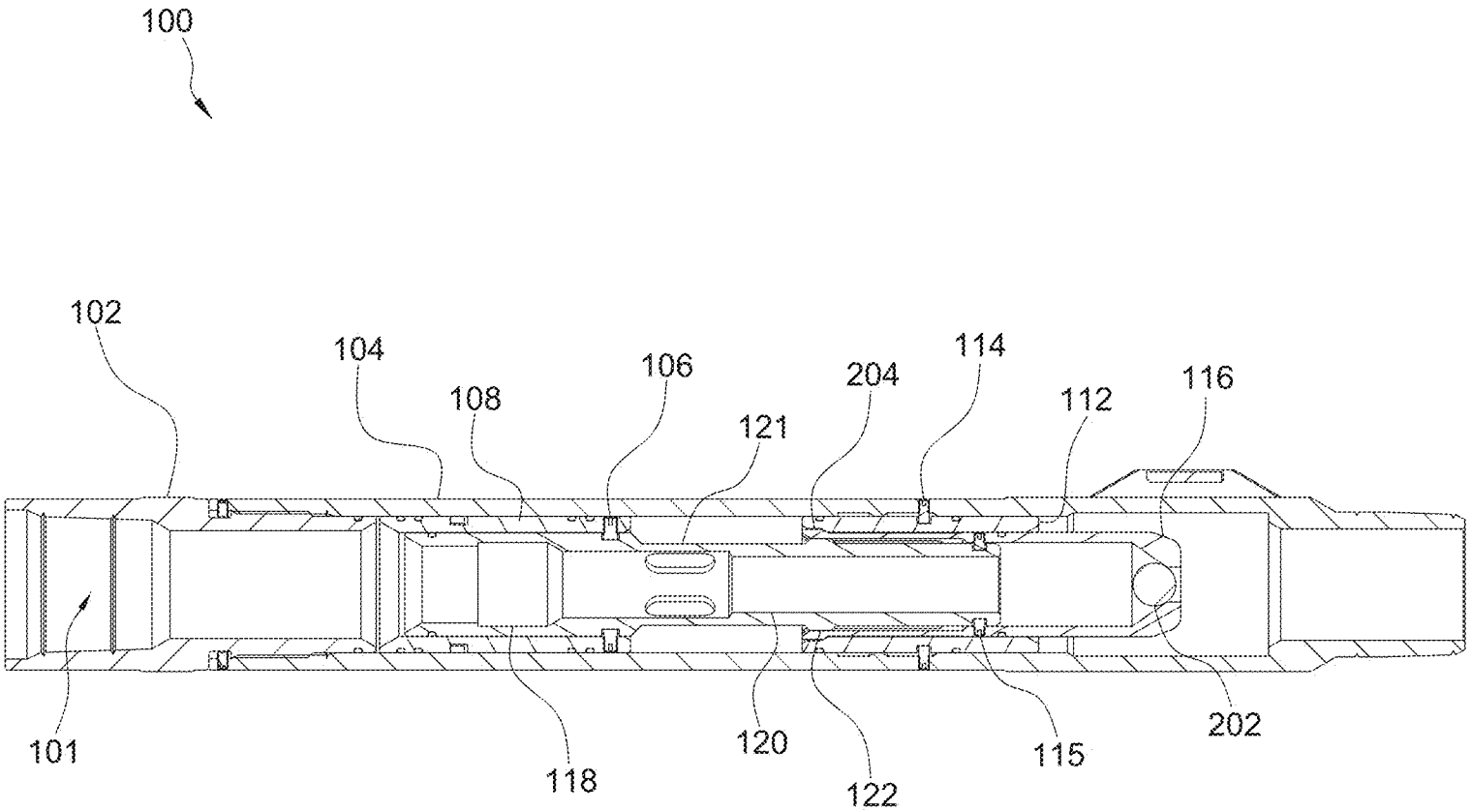
FIG. 2 is a side, cross-sectional view of the multiple stage cementing tool of FIG. 1 with an opening ball dropped downhole.

100-stage cementing tool
101-inner bore
102-upper body
104-lower body
106-connector(s)
108-closing sleeve
112-opening sleeve
114-connector(s)
115-connector(s)
116-opening seat
117-shoulder

118-closing seat
120-opening seat collet retainer
121-Coupling
122-Fins
200-circulation ports
202-opening ball
204-collet
300-Internal ports The drawing figures do not limit the invention to the specific embodiments disclosed and described herein. The drawings are not necessarily to scale, emphasis instead being placed upon clearly illustrating the principles of the invention.

DETAILED DESCRIPTION

The following detailed description references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the invention. The following detailed description is, therefore, not to be taken in a limiting sense. The scope of the invention is defined only by the appended claims, along with the full scope of the equivalents to which such claims are entitled.

In this description, references to "one embodiment," "an embodiment," or "embodiments" mean that the feature or features being referred to are included in at least one embodiment of the technology. Separate references to "one embodiment," "an embodiment," or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the technology can include a variety of combinations and/or integrations of the embodiments described herein.

Well drilling operations are well known in the art, particularly in the oil and gas industry. Stage cementing tools are commonly run downhole with the casing string for use in cementing operations. Specifically, the tool is usually placed along the casing string being run downhole, wherein a first configuration of the tool allows for fluid flow through the tool and downhole of the tool. As is understood by those skilled in the art, circulation ports within the tool may be opened, thereby allowing for fluid flow into an annulus space. Similarly, as understood by those skilled in the art, the circulation ports may be closed for continued well operations. A plurality of stage cementing tools may be used along the casing, or in other words, for each stage along the length of the casing as needed. The manipulation of such tools from one configuration to the next is usually achieved through applied pressure from a surface, such as through fluid flow and/or dropping of one or more balls or plugs into the tool.

The present invention provides for a stage cementing tool that incorporates an opening seat with a high-pressure rating due to the configuration explained herein. The high-pressure rating allows for a greater annular section of the wellbore to be cemented in a single stage, which therefore reduces the overall number of tools needed along the length of the casing.

FIGS. 1 through 7 depict cross-sectional views of a stage cementing tool 100 in accordance with the present invention. The stage cementing tool 100 includes a body, which in embodiments is composed of an upper body 102 and a lower body 104, which are connected by any means conventional in the art, such as a threaded connection. The upper body 102 is configured to engage with a casing string (not shown), again by any means conventional in the art such as a threaded connection. The upper and lower bodies 102, 104 create an inner bore 101 through which fluid may flow when the inner bore 101 is in an open configuration.

Figure 3:
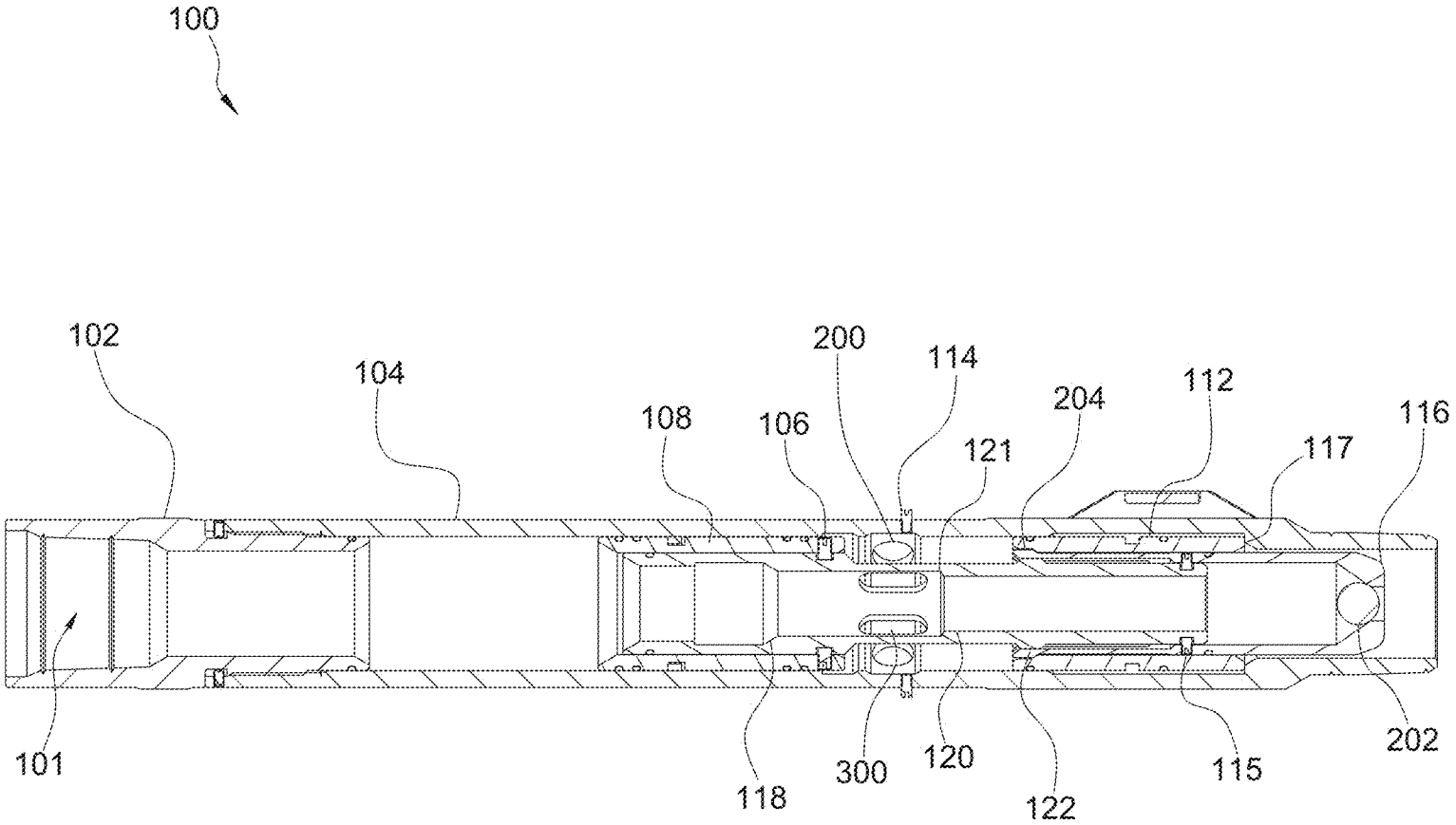
FIG. 3 is a side, cross-sectional view of the multiple stage cementing tool of FIG. 1 with the opening sleeve in a second position and the closing sleeve in a second position, such that circulation ports are open, in accordance with the present invention.

As best shown in FIG. 3, one or more circulation ports 200 extend through a thickness of the lower body 104 such that fluid may pass from the inner bore 101 into an annulus space when the one or more circulation ports 200 are open. The size and number of circulation ports 200 may vary as understood in the art.

The tool 100 further includes an opening sleeve 112 mounted within the lower body 104 via one or more connectors 114, such as shear pins, that allow for release of the opening sleeve 112 when a predetermined threshold pressure is reached. An opening seat 116 is attached to the opening sleeve 112 in such a configuration that requires a high pressure to release from the opening sleeve 112. In embodiments, an opening seat collet retainer 120 is used to couple the opening seat 116 to the opening sleeve 112 to achieve the desired high-pressure rating. Accordingly, as pressure is applied to the retainer 120, the retainer 120 will release from one or more connectors 115, such as shear pins, thereby allowing for the retainer 120 to travel downhole to the opening seat 116 and therefore transmit pressure to the opening seat 116 to release from the opening sleeve 112. This is discussed in greater detail herein.

The tool 100 further includes a closing sleeve 108 mounted within the lower body. In addition, a closing seat 118 is attached to the closing sleeve 108 via additional connectors 106, such as shear pins. In the embodiment shown, the closing seat 118 includes a coupling 121 that attaches to the collet retainer 120. In other words, in some embodiments, the closing seat 118, coupling 121, and collet retainer 120 are a single body. Those skilled in the art will appreciate that these elements may be configured into multiple entities, and secured together, or manufactured as a single entity, or in embodiments remain separate.

In operation, the tool 100 is secured at a desired position along the casing string (not shown) and run downhole in the configuration shown in FIG. 1, wherein the inner bore 101 is open to allow fluid circulation and pressure cycles as needed to perform desired well operations. At a desired depth, and as demonstrated in FIG. 2, an opening ball 202 is launched and lands within the opening seat 116. The applied pressure from the opening ball 202 causes the opening seat 116, opening sleeve 112, the closing sleeve 108, the closing seat 118, and the retainer 120 to all shift from a first position (FIG. 1) to a second position (FIG. 3) such that the opening sleeve 112 is supported and stopped by a shoulder 117 extending inwardly into the lower body 104. In other words, an amount of pressure necessary to release connector 114 is applied via ball 202, causing a release of the entire internal apparatus into a second position shown in FIG. 3. As the opening sleeve 112 and opening seat 116 shift from the first to second position, the circulation ports 200 open. As further shown in FIG. 3, internal ports 300 extending through a thickness of the coupling 121 align such that fluid can flow through the internal ports 300 and then through the circulation ports 200. In this configuration, fluid can circulate from inside the tool 100 to outside of the tool 100 through the ports 200, 300, while fluid flow through a downhole end of the tool 100 is blocked. Accordingly, the operations team can complete cementing operations in the annular space of the wellbore.

Figure 5:
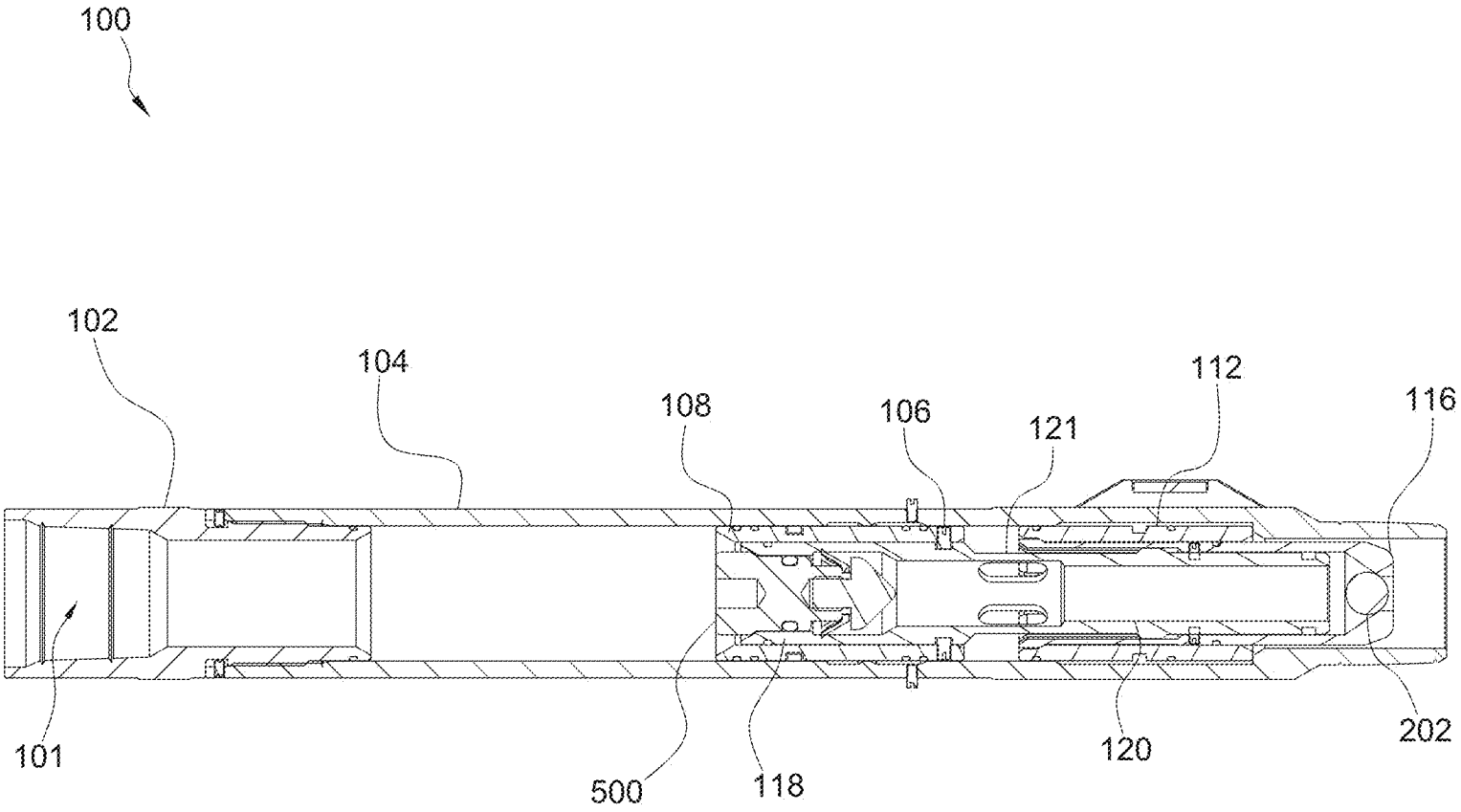
FIG. 5 is a side, cross-sectional view of the multiple stage cementing tool of FIG. 1 with the closing sleeve shifted into a third position to close the circulation ports, and an opening sleeve collet retainer disengaged from an opening seat in accordance with the present invention.

The configuration of the opening sleeve 112, opening seat 116, and opening seat collet retainer 120 in combination, create an arrangement for withstanding higher pressure than conventional stage cementing tools. The opening seat collet retainer 120 retains a collet 204 of the opening seat 116 in an open position, such that the collet 204 rests on and is supported by the opening sleeve 112, as shown in at least FIG. 2, until the opening seat collet retainer 120 is disengaged, as shown in FIG. 5. Once disengaged, the opening seat 116 at the collet 204 can depress inward at the collet 204 to release from the opening sleeve 112. In embodiments, an outwardly protruding fin 122 from the retainer 120 provides for force against the collect 204 to create said retainment.

Figure 4:
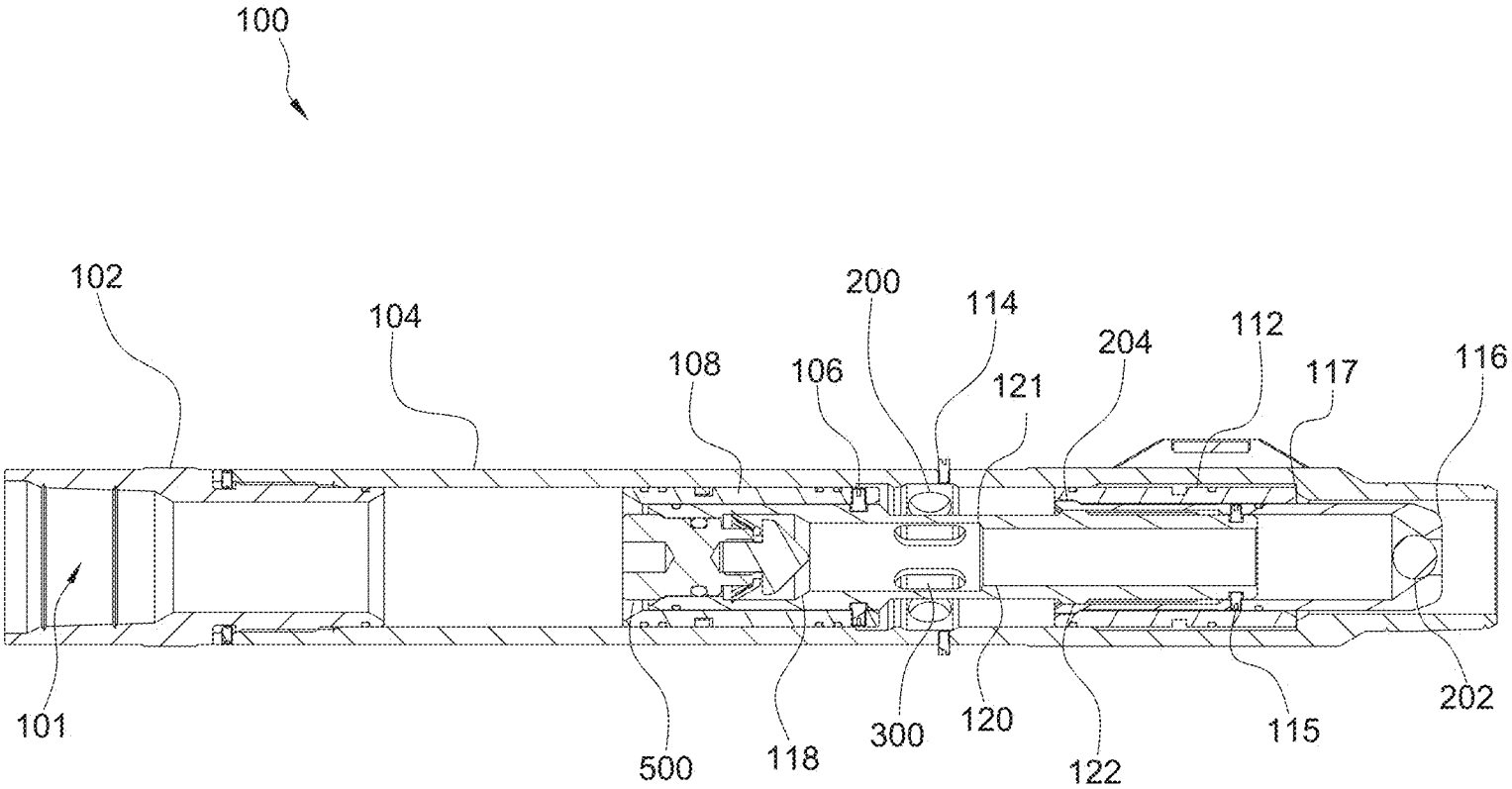
FIG. 4 is a side, cross-sectional view of the multiple stage cementing tool of FIG. 1 with the opening sleeve in the second position and the closing sleeve in the second position, with a plug dropped downhole.

In FIGS. 3 and 4, the tool 100 is shown in the open port configuration. In FIG. 5, the tool 100 is shown in a closed configuration. After cementing operations, or as understood and needed by an operator, a closing plug 500 is launched from the surface to engage with the closing seat 118 as shown in FIG. 4, such that applied pressure causes the closing seat 118, the closing sleeve 108, and coupling 121 to shift downward, further applying pressure to the collet retainer 120, such that the collet retainer 120 releases from the opening seat 116 via connectors 115. The closing sleeve 108 moves into a third and closed position (shown in FIG. 5), thereby covering and closing the circulation ports 200. As will be understood by those skilled in the art, locking mechanisms, plugs, seals, or the like are part of the tool 100.

Figure 6:
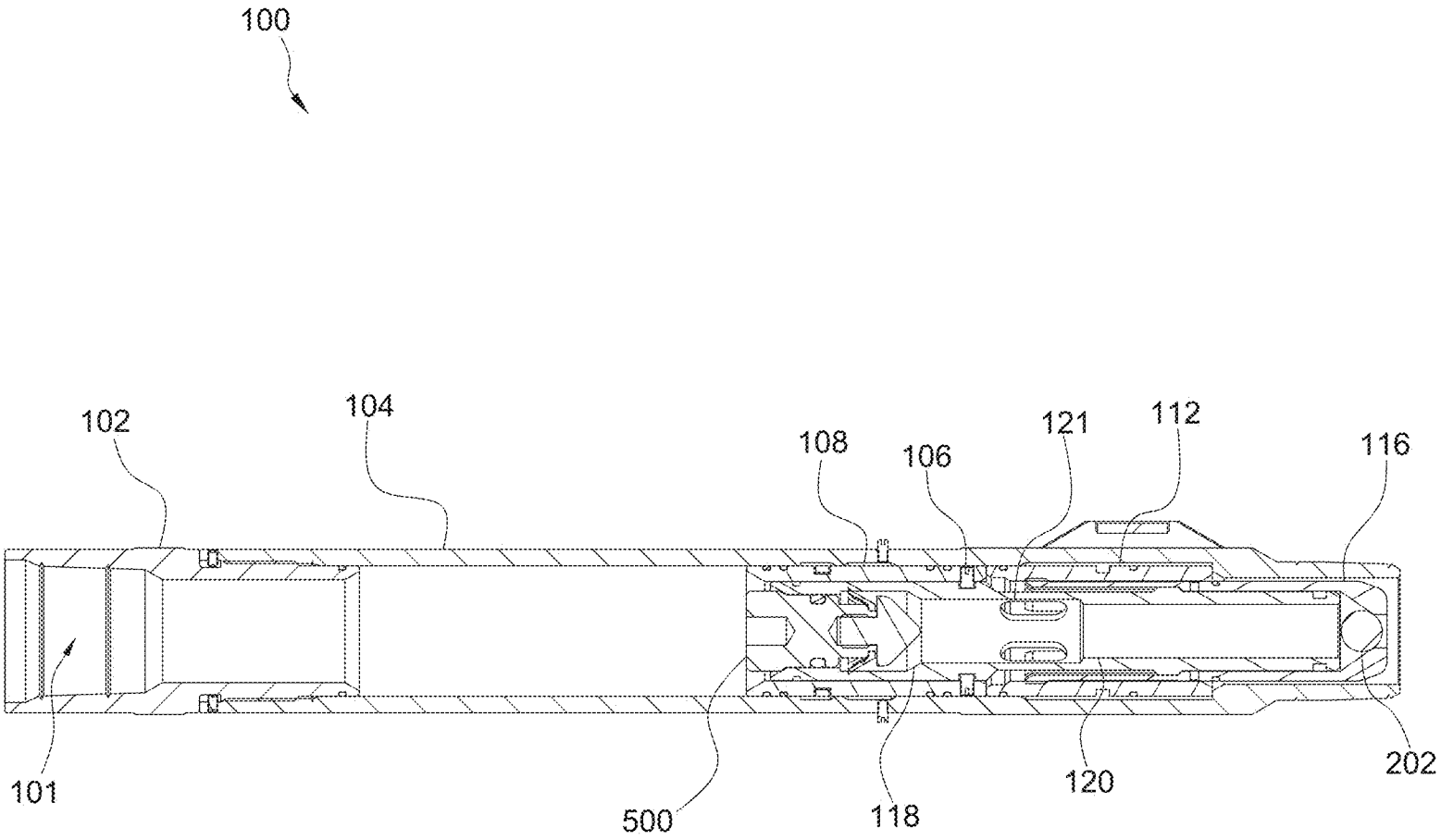
FIG. 6 is a side, cross-sectional view of the multiple stage cementing tool with the closing sleeve shifted into a fourth position, as stopped by the opening sleeve in accordance with the present invention.
Figure 7:
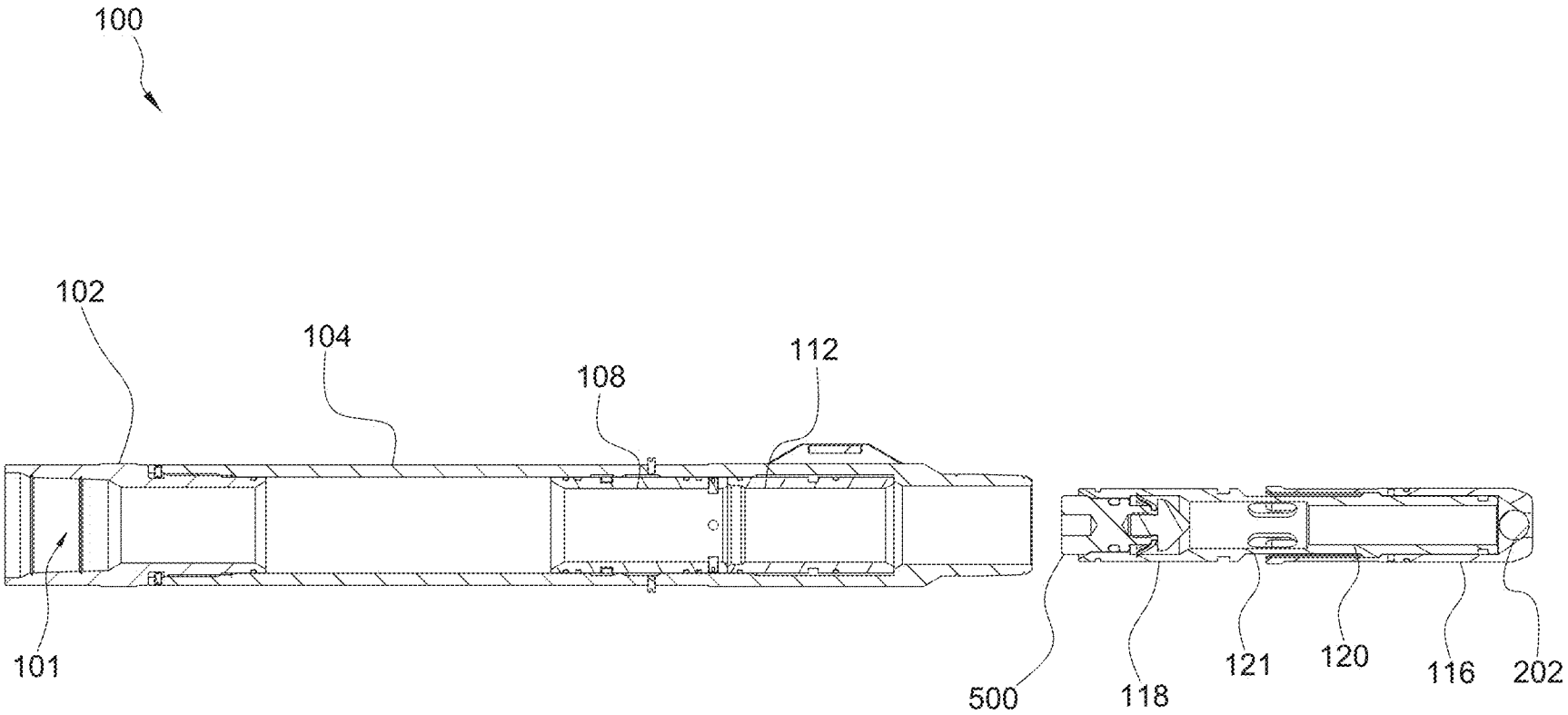
FIG. 7 is a side, cross-sectional view of the multiple stage cementing tool with the opening seat, closing seat, opening seat collet retainer, coupling, and plug displaced from the multiple stage cementing tool in accordance with the present invention.

In FIGS. 6 and 7, as the plug 500 continues applying pressure, additional releasing takes place. Specifically, the closing seat 118 releases from the closing sleeve 108 upon an application of pressure and continues to transmit pressure to the opening seat collet retainer 120 and opening seat 116. Next, as shown in FIG. 7, as the closing seat 118 releases, the plug 500, closing seat 118, and opening seat 116, along with the opening seat collet retainer 120 and coupling 121, are released from the tool and travel downhole, thereby opening the tool 100. In other words, as shown in FIG. 7, the opening seat 116, opening seat collet retainer 120, coupling 121, opening ball 202, closing seat 118, and plug 500 all travel downhole to fully open the tool 100 for fluid flow. This release of the inner components of the tool 100 is achieved through an application of pressure above a threshold. The application of pressure, as discussed above, is greater than that needed in conventional stage cementing tools.

The present invention provides for an opening seat 116 that can withstand high pressure loads, which allows for a larger annular length to be filled for a single stage. Accordingly, the number of tools needed for an entire well depth or casing length is reduced, which reduces the overall cost associated with the well operation.

Many different arrangements of the various components depicted, as well as components not shown, are possible without departing from the spirit and scope of the present disclosure. Embodiments of the present disclosure have been described with the intent to be illustrative rather than restrictive. Alternative embodiments will become apparent to those skilled in the art that do not depart from its scope. A skilled artisan may develop alternative means of implementing the aforementioned improvements without departing from the scope of the present disclosure.

The invention claimed is:

1. A cementing tool for use in well drilling operations, the cementing tool comprising:

a body to engage with a casing string and forming an inner bore, the body having one or more circulation ports allowing flow from the inner bore to an exterior of the body;

an opening sleeve mounted within the body and configured to release from a first opening sleeve position to open the one or more circulation ports when in a second opening sleeve position;

an opening seat attached to the opening sleeve via a collet;

an opening seat collet retainer engaged with the opening seat;

a closing sleeve mounted within the body above the opening sleeve, the closing sleeve configured to release from a first closing sleeve position to close the one or more circulation ports;

a closing seat attached to the closing sleeve;

wherein the closing seat is configured to apply pressure to the opening seat collet retainer; and wherein the opening seat collet retainer is configured to release from the opening seat once a predetermined amount of pressure is applied from the closing seat.

2. The cementing tool of claim 1, wherein the body comprises an upper body to engage with the casing string and a lower body to engage with the upper body.

3. The cementing tool of claim 1, wherein the opening seat collet retainer is coupled to a coupling as part of the closing seat.

4. The cementing tool of claim 3, wherein the coupling further comprises one or more internal ports.

5. The cementing tool of claim 1, further comprising a shoulder extending into the inner bore of the body, the shoulder configured to engage with the opening sleeve to prevent the opening sleeve from fully traveling downhole.

6. The cementing tool of claim 1, wherein the opening seat collet retainer further comprises a fin extending outward such that the fin applies pressure to the collet as part of the opening seat, wherein when said pressure is applied, the collet is supported by the opening sleeve, and wherein when said pressure is removed, the collet is configured to depress inward to release from the opening sleeve.

7. A method of using a cementing tool within a wellbore, the method comprising:

providing the cementing tool having:

a body to engage with a casing string and forming an inner bore, the body having one or more circulation ports allowing flow from the inner bore to an exterior of the body;

an opening sleeve mounted within the body and configured to release from a first opening sleeve position to open the one or more circulation ports when in a second opening sleeve position;

an opening seat attached to the opening sleeve via a collet;

an opening seat collet retainer engaged with the opening seat;

a closing sleeve mounted within the body above the opening sleeve, the closing sleeve configured to release from a first closing sleeve position to close the one or more circulation ports;

a closing seat attached to the closing sleeve;

wherein the closing seat is configured to apply pressure to the opening seat collet retainer; and wherein the opening seat collet retainer is configured to release from the opening seat once a predetermined amount of pressure is applied from the closing seat;

running the cementing tool downhole with the opening sleeve in the first opening sleeve position and the closing sleeve in the first closing sleeve position such that the one or more circulation ports are closed via the opening sleeve;

applying a first pressure to the opening sleeve such that the opening sleeve disengages from the body and moves to the second opening sleeve position, thereby opening the one or more circulation ports;

performing one or more well operations;

applying a second pressure to the closing sleeve such that the closing sleeve travels downhole and moves into a closing position, thereby closing the one or more circulation ports; and applying a third pressure to the closing seat such that the closing seat disengages from the closing sleeve;

wherein the closing seat, opening seat, and opening seat collet retainer all travel out of the cementing tool to open the cementing tool to fluid flow.

8. The method of claim 7, wherein the body comprises an upper body to engage with the casing string and a lower body to engage with the upper body.

9. The method of claim 7, wherein the opening seat collet retainer is coupled to a coupling as part of the closing seat.

10. The method of claim 7, wherein the body further comprises a shoulder extending into the inner bore of the body, the shoulder configured to engage with the opening sleeve when the opening sleeve is in the second opening sleeve position.

* * * * *